US007972172B2

(12) United States Patent
Huang et al.

(10) Patent No.: US 7,972,172 B2
(45) Date of Patent: Jul. 5, 2011

(54) CABLE END CONNECTOR ASSEMBLY

(75) Inventors: Jian-Lin Huang, Kunshan (CN); Feng Pan, Kunshan (CN); Chih-Ming Chien, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/612,708

(22) Filed: Nov. 5, 2009

(65) Prior Publication Data

US 2010/0112864 A1 May 6, 2010

(30) Foreign Application Priority Data

Nov. 6, 2008 (CN) ..... 200820302659
Apr. 7, 2009 (CN) ..... 200920301952
Apr. 7, 2009 (CN) ..... 200920301958

(51) Int. Cl.
*H01R 9/05* (2006.01)

(52) U.S. Cl. ..... 439/578; 439/607.44

(58) Field of Classification Search ..... 439/578–581, 439/607.41, 607.44, 607.5
See application file for complete search history.

(56) References Cited

U.S. PATENT DOCUMENTS 4,963,104 A * 10/1990 Dickie ..... 439/460
5,055,068 A * 10/1991 Machura et al. ..... 439/581
5,180,316 A * 1/1993 Miller et al. ..... 439/607.5
5,482,477 A * 1/1996 Michael ..... 439/581
5,913,694 A * 6/1999 Wright ..... 439/394
6,036,543 A 3/2000 Panis et al.
6,065,998 A * 5/2000 Peloza ..... 439/578
6,109,976 A 8/2000 van Zanten et al.
6,122,239 A * 9/2000 Bodo et al. ..... 711/111
6,203,377 B1 3/2001 Grek et al.
7,021,967 B2 * 4/2006 Mullin ..... 439/607.41
7,300,309 B2 * 11/2007 Montena ..... 439/578

* cited by examiner

*Primary Examiner* — Truc T Nguyen

(74) *Attorney, Agent, or Firm* — Andrew C. Cheng; Wei Te Chung; Ming Chieh Chang

(57) ABSTRACT

A cable connector assembly includes a cable (5) and a connector (100) terminated to the cable (5). The connector (100) further includes a connector body (20), a cover means (9) fastening the connector body (20) and connecting means (7) securing said cable (5) to the cover means (9). The connecting means (7) further includes an outer ferrule (73) having a first part (733) crimped onto the cable and a second part (731) crimped onto a shield (53) of the cable 5, and an inner ferrule (71) fastened substantially under the shield (53) to the outer ferrule (73) in the area of the second part (731) for making an axial locking between the outer ferrule (73) and the inner ferrule (71). The inner ferrule (71) forms a number of resilient tabs (719) flexibly abutting the cover means (9) thereby making firmly electrical connection to the cover means (9).

19 Claims, 10 Drawing Sheets

CABLE END CONNECTOR ASSEMBLY

BACKGROUND OF THE INVENTION

1. Field of the Invention

The present invention relates to a cable end connector assembly, and more particularly to a cable end connector assembly having a firm connecting means between a cable and a connector.

2. Description of Related Art

U.S. Pat. No. 6,203,377, issued to Grek et al. on Mar. 20, 2001, discloses a connector for a cable with at least one conductor and a shielding. The connector comprises a cover means designed for electrical communication, and connecting means connectable to the shielding and the cover means. The connecting means comprises an outer ferrule of which a first part is crimped onto said cable for fastening said connecting means to said cable and a second part is crimped onto said shielding for electrical communication.

U.S. Pat. No. 6,109,976, issued to Zanten et al. on Mar. 14, 2000, discloses a connector assembly for connecting a shielded cable with a plurality of conductors and a common shielding to a printed circuit board comprises a first connector having a housing of insulating material with contacts connected with the conductors and a metal hood connected with the common shielding. The housing is accommodated in the hood and comprises an insertion part protruding out of the hood along its complete circumference. The connector assembly comprises a second connector with a shielding lying at a distance from the second connector, the second connector having a receiving space for receiving the insertion part of the housing. The second connector with the shielding is mounted on the printed circuit board and the shielding is connected to a corresponding connector of the printed circuit board. The hood is provided with at least one projecting flange connected to the shielding of the second connector when the insertion part of the housing is inserted into the receiving space of the second connector.

SUMMARY OF THE INVENTION

An object of the present invention is to provide a cable end connector assembly comprising a cable and an connector firmly terminated to the cable.

A cable connector assembly comprising a cable, a connector body for mating with a complementary mating connector and connecting means securing said cable to the connector body is provided. The cable comprises a plurality of conductors, a shield and a jacket, and has an end with the plurality of conductors and the shield exposed from the jacket. The cover means is designed for electrical communication and secures said end of the cable to said connector body. The connecting means comprises an outer ferrule having a first part crimped onto said jacket for fastening said connecting means to said cable and a second part crimped onto said shield for electrical communication, and an inner ferrule fastened substantially under said shield to said outer ferrule in the area of the second part for making an axial locking between said outer ferrule and said inner ferrule. The inner ferrule further comprises a plurality of resilient tab flexibly abutting said cover means thereby making electrical connection to the cover means.

According to another aspect of the present invention, another cable connector assembly is provided. The cable end connector assembly comprises a cable and a connector terminated to the cable. The cable comprises a plurality of conductors and has an end with the plurality of conductors exposed from the jacket. The connector comprises a connector body for mating with a complementary mating connector, a cover means designed for electrical communication and connecting means fixed to the cover means. The end of cable is securely fixed to the connector body by the cover means. The connector body further comprises a first contact module and an insulating cover insulating said first contact module from said cover means. The first contact module comprises a plurality of conductive contacts respectively and electrically connected to corresponding conductors of the cable. The first contact module forms a bump mating with the cover means thereby fixing said connector body to said cover means.

According to another aspect of the present invention, another cable connector assembly is provided. The cable end connector assembly comprises a cable and a connector terminated to the cable. The cable comprises a plurality of conductors, said cable having an end with the plurality of conductors exposed from the jacket. The connector comprises a connector body for mating with a complementary mating connector, a cover means designed for electrical communication and connecting means fixed to the cover means. The end of the cable is securely fixed to the connector body by the cover means. The connector body further comprises a first contact module, a second contact module stacked with said first contact module and an insulating cover insulating said first and second contact modules from said cover means. Each of the first and the second contact modules comprises a plurality of conductive contacts respectively and electrically connected to corresponding conductors of the cable. The first contact module defines a pair of concavities and the second contact module forms a pair of bumps mating into said concavities of the first contact module thereby fixing the two contact module together.

Other objects, advantages and novel features of the invention will become more apparent from the following detailed description of a preferred embodiment when taken in conjunction with the accompanying drawings.

DETAILED DESCRIPTION OF THE INVENTION

Figure 1:
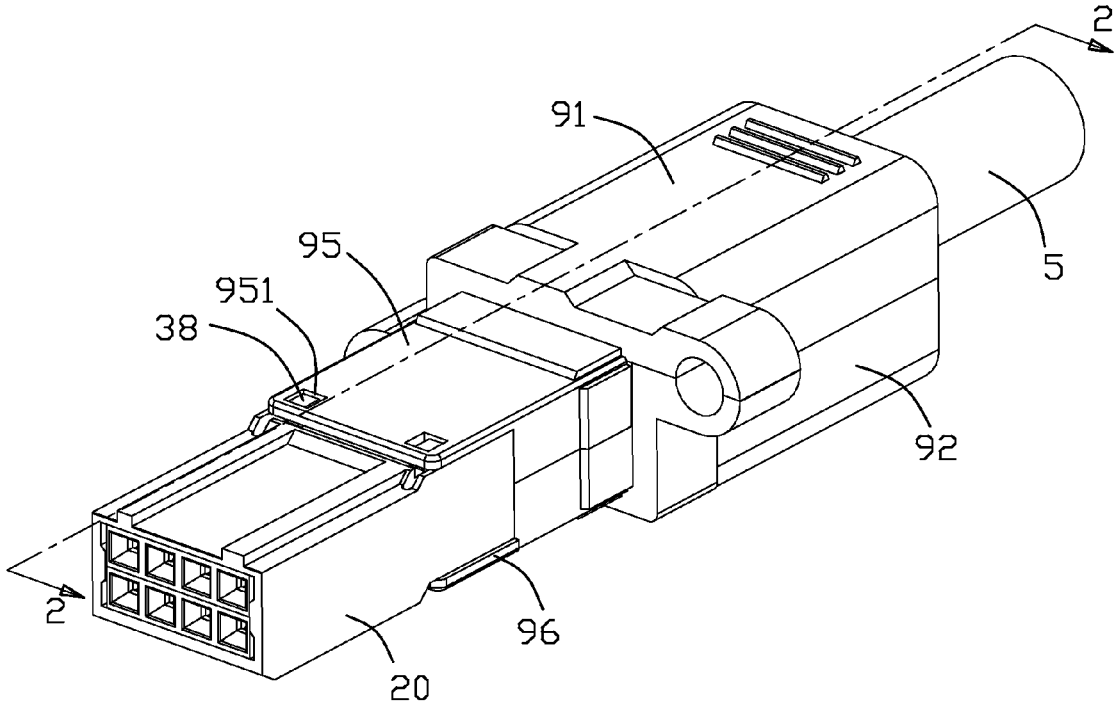
FIG. 1 is a perspective view of a cable end connector assembly according to an embodiment of the present invention.

Reference will now be made to the drawing figures to describe the present invention in detail.

Referring to FIGS. 1-5, a cable end connector assembly according to an embodiment of the present invention is shown. The cable end connector assembly comprises a connector 100 with a cable 5 terminated to an end thereof.

The cable 5 is configured by a plurality of conductors 51, a braided shield 53 enclosing the conductors 51, and a jacket 55 enclosing the braided shield 53. The cable 5 is arranged with a section of the conductors 51 and braiding 53 exposed at the end.

The connector 100 comprises a connector body 20 for mating with a complementary mating connector (not shown), a cover means 91, 92 designed for shielding and being used to securely attach the end of the cable 5 to the connector body 20, and connecting means 7 interface between the shield 53 of the cable 5 and the cover means 91, 92.

Figure 2:
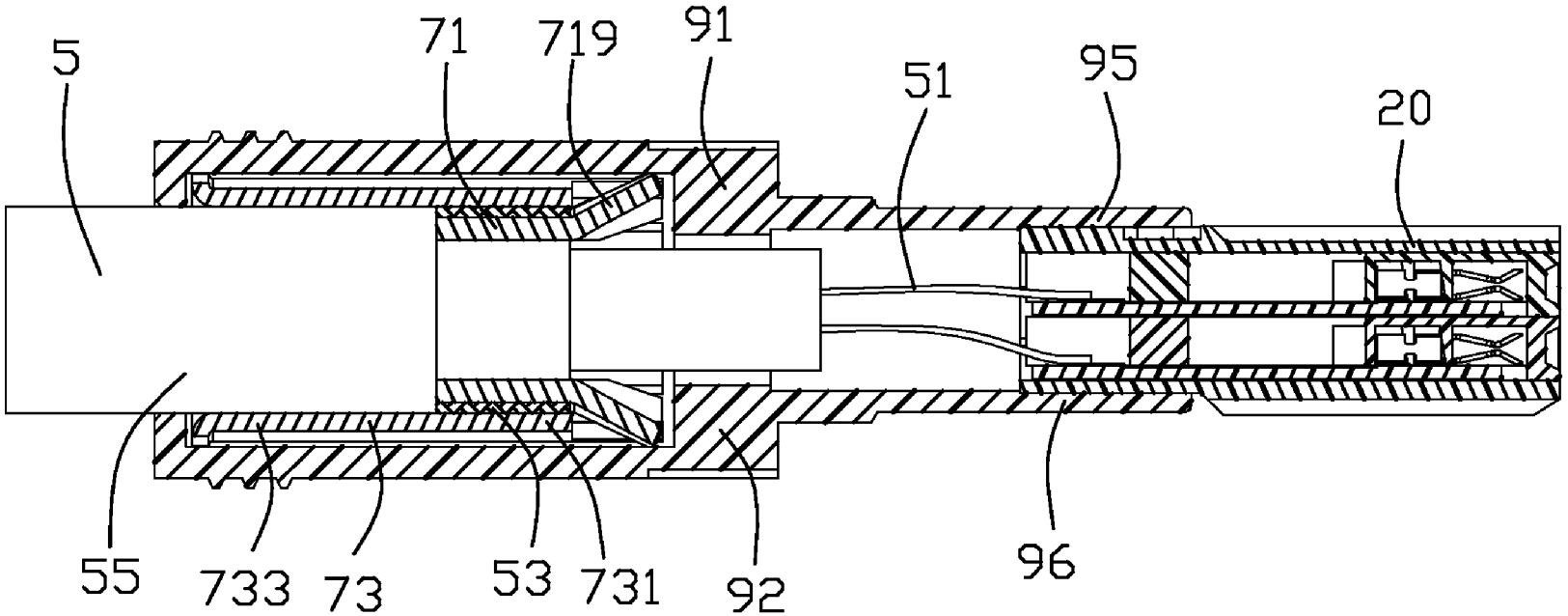
FIG. 2 is a cross-section view of the cable end connector assembly shown in FIG. 1 along a line of 2-2.
Figure 3:
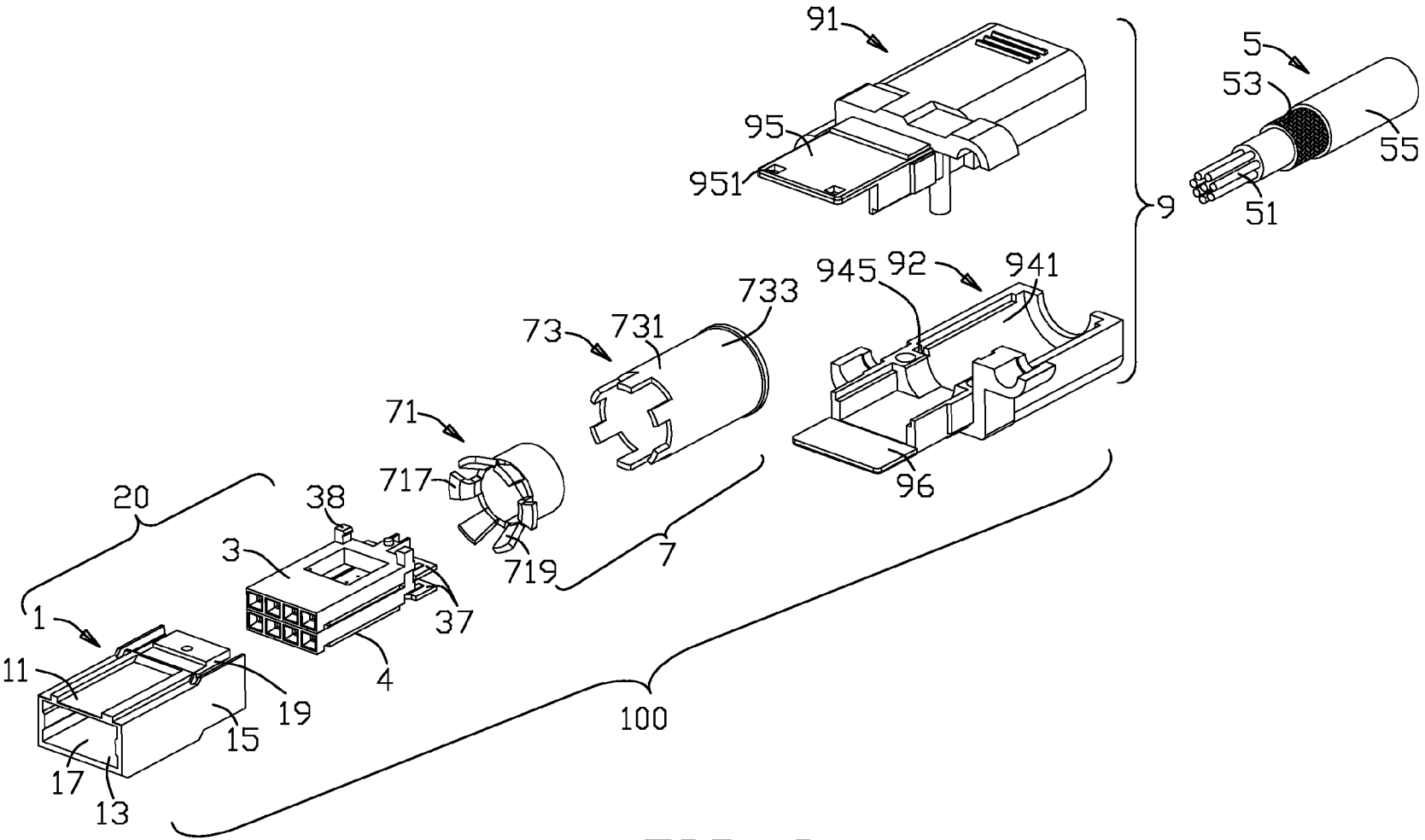
FIG. 3 is an exploded view of the cable end connector assembly shown in FIG. 1.
Figure 4:
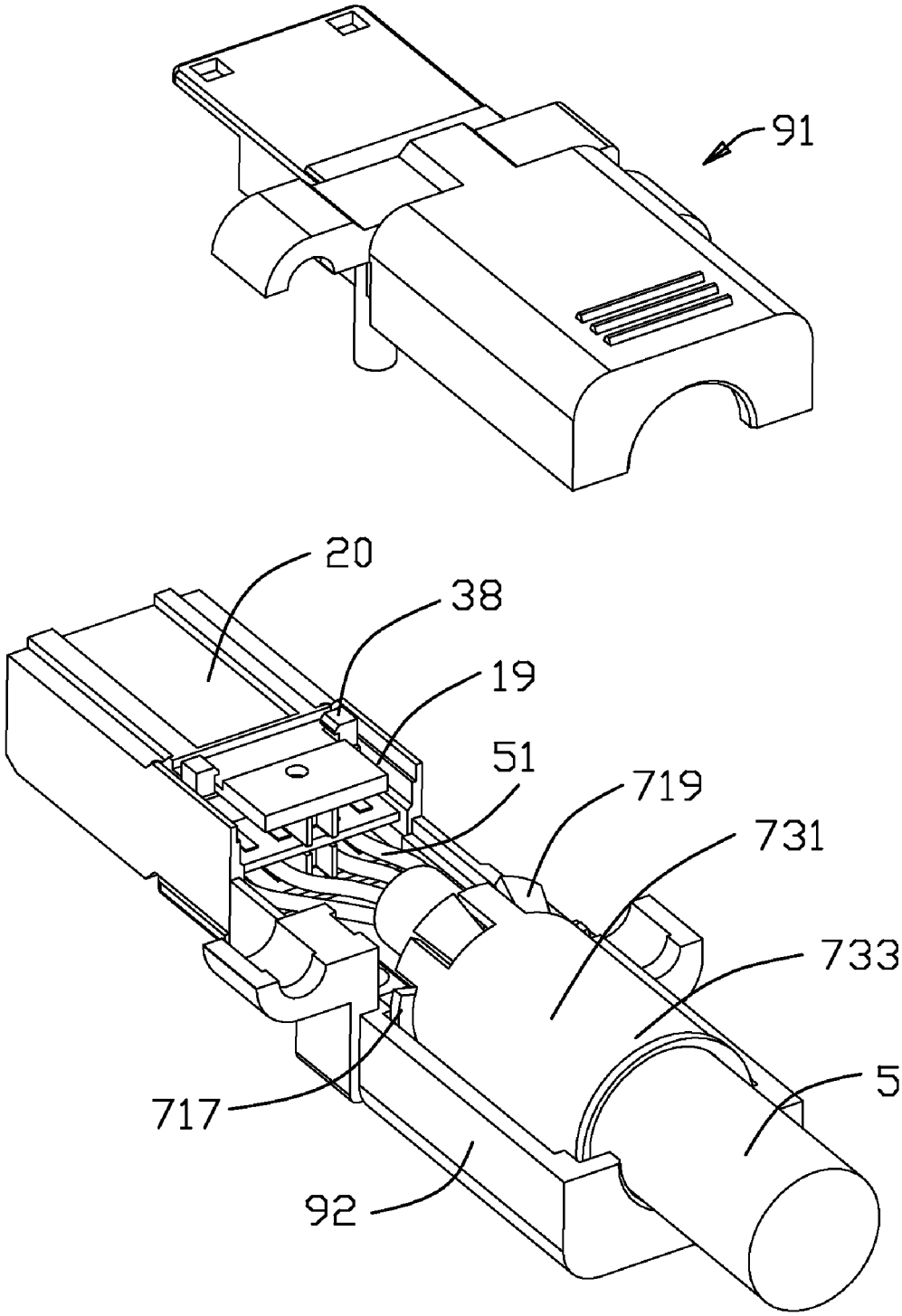
FIG. 4 is a perspective view of the cable end connector assembly shown in FIG. 1 with a top cover removed for clearly shown the connecting means.
Figure 5:
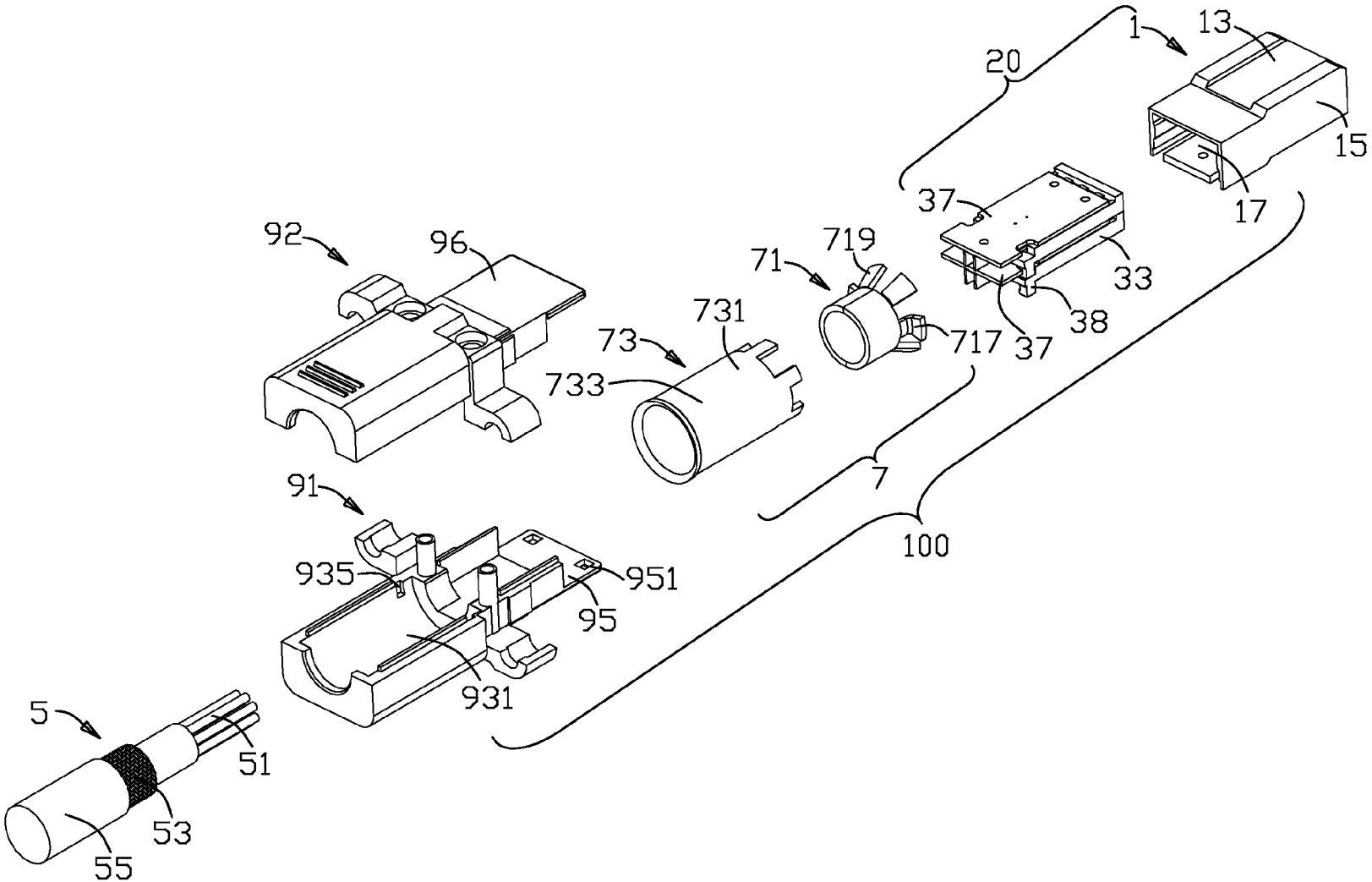
FIG. 5 is an exploded view of the cable end connector assembly shown in FIG. 1 from an alternative direction.
Figure 10:
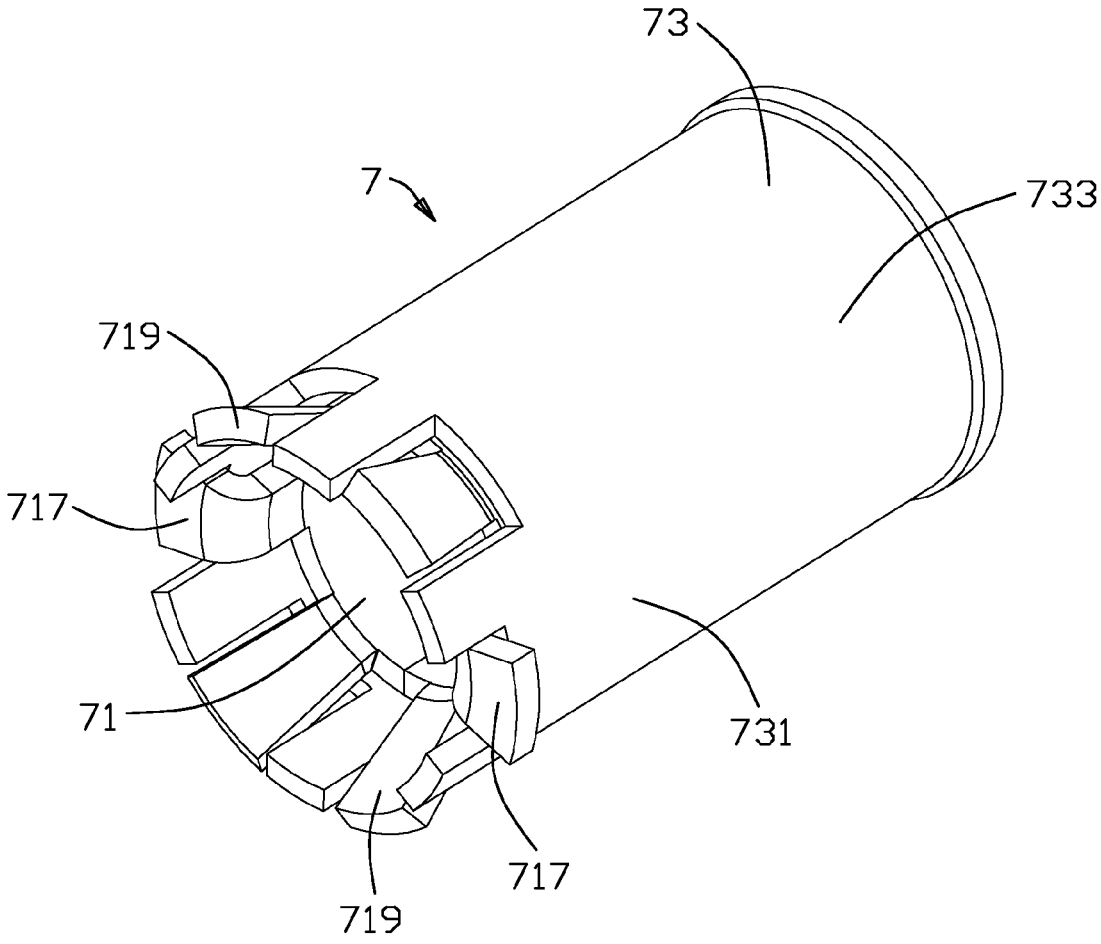
FIG. 10 is a perspective view of the connecting means of the connector shown in FIG. 3 with the outer ferrule and the inner ferrule in a mated position.

Referring to FIGS. 2, 4 and 10, the connecting means 7 comprises an outer ferrule 73 and an inner ferrule 73. The outer ferrule 73 has a first part 733 crimped onto said jacket 55 for fastening said connecting means 7 to said cable 5 and a second part 731 crimped onto said braided shield 53 for electrical communication. The braiding 53 is sandwiched between the inner and outer ferrules 71/73. With the interposing of the braiding 53 in between, the inner and outer ferrules 71/73 are securely interlocked together. The inner ferrule 73 further comprises a plurality of resilient tab 719 and a pair of bumps 717. The plurality of resilient tabs 719 flexibly abut against said cover means 91, 92 thereby making electrical connection to said cover means 91, 92. Since the outer ferrule 73 is disposed between the inner ferrule 71 and the cover means 91, 92, a gap is defined therebetween, which provides a space for the resilient tab 719 slantwise extending towards the cover means 91, 92 therein, which increases the flexibility of the resilient tab 719. The bumps 717 mate into a pair of concavities 935, 945 defined in the cover means 91, 92 and thereby securing said connecting means 7 to said cover means 91, 92.

The cover means 90 (91/92) is configured by a top cover 92 and a bottom cover 91 each defines a cavity (911/921) so as to jointly define a space to receive the connecting means 7 therein. Each of the top and bottom covers 91/92 further includes a planar portion/plates 95/95 with the connector body 20 sandwiched therein.

Referring to FIGS. 5-9, the connector body 20 further comprises a first contact module 3, a second contact module 4 stacked with said first contact module 3 and an insulating cover 1 insulating said first and second contact modules 3, 4 from said cover means 91, 92. Each of the first and the second contact modules 3, 4 comprises a plurality of conductive contacts 35 respectively connected to corresponding conductors 51 of the cable 5, defines a pair of concavities 39 in a first surface, and forms a pair of bumps 38 on a second surface opposite to the first surface. The pair of bumps 38 of the second module 4 mates into the pair of concavities 39 of the first contact module 3. The first contact module 3 further defines a first side surface 393 in one of the concavities 39, a groove 391 in the first side surface 393, a second side surface 395 opposite to said first side surface 393 in the other concavity 39, and a groove 391 in said second side surface 395. Each of said bumps 38 of the second contact module 4 forms a latch 381 corresponding to respective grooves 391 of the first contact module 3. In a preferred embodiment of the present invention, the first and the second contact modules 3, 4 have a same configuration. When the first contact module 3 is stacked with the second contact module 4, the bumps 38 of the second contact module 4 mate into the concavities 39 of the first contact module 3 and the latches 381 of the bumps 38 are snapped into the grooves 391 of the concavities 39 of the first contact module 3 thereby fixing the two contact module 3, 4 together.

Each of the contact modules 3, 4 comprises a printed circuit board 37 and an insulating housing 33. The printed circuit board 37 forms a plurality of first conductive pads 371 connected to the contacts 35, a plurality of second conductive pads 373 and a plurality of conductive trace electrically connected between the first conductive pads 371 and the second conductive pads 373. The contacts 35 are respectively soldered onto the first conductive pads 371. The conductors 51 are respectively soldered onto the second conductive pads 373. The printed circuit board 37 together with the contact 35 is assembled to a side of the insulating housing 33 thereby forming the contact module 3, 4.

Figure 6:
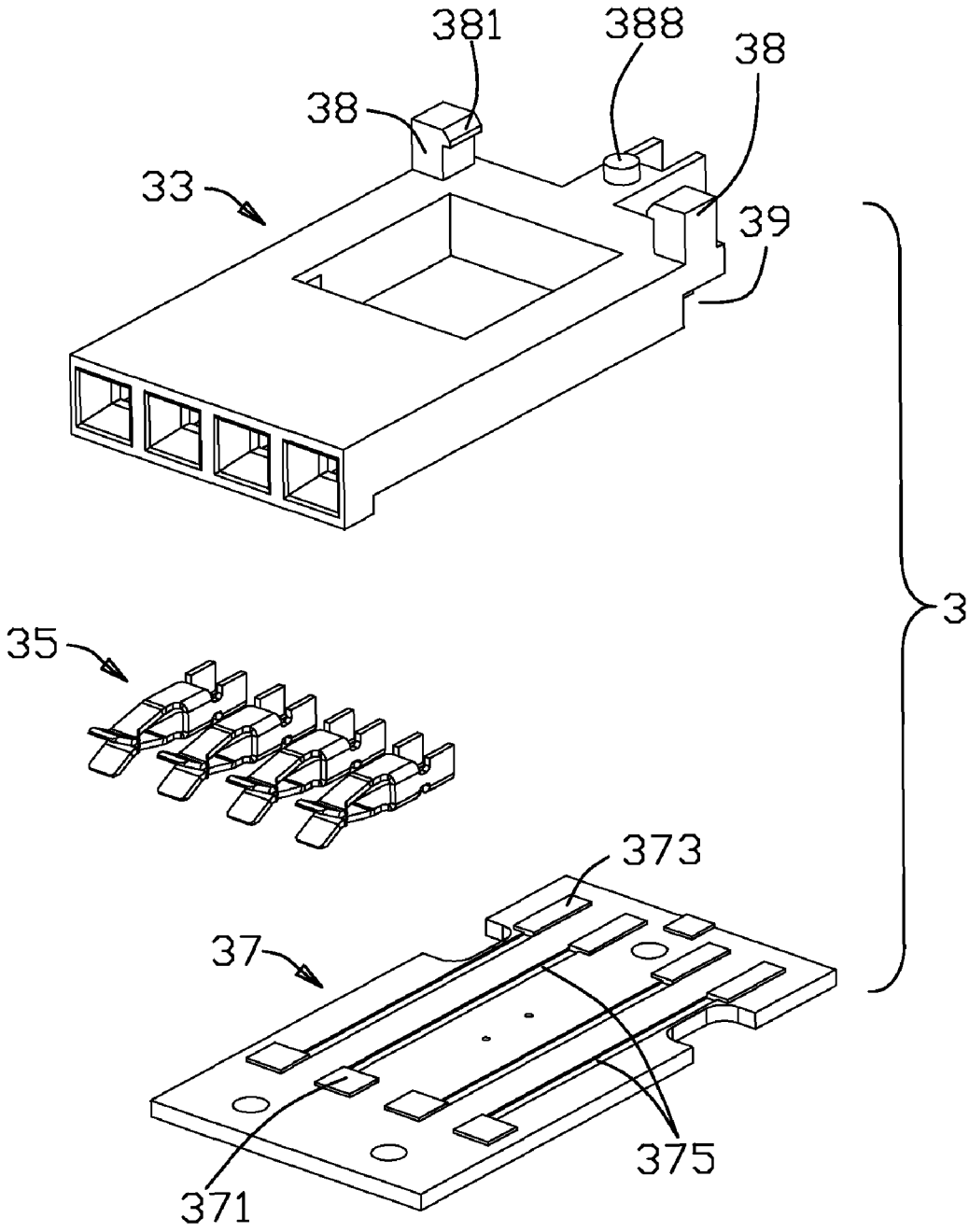
FIG. 6 is an exploded view of a contact module shown in FIG. 3.
Figure 7:
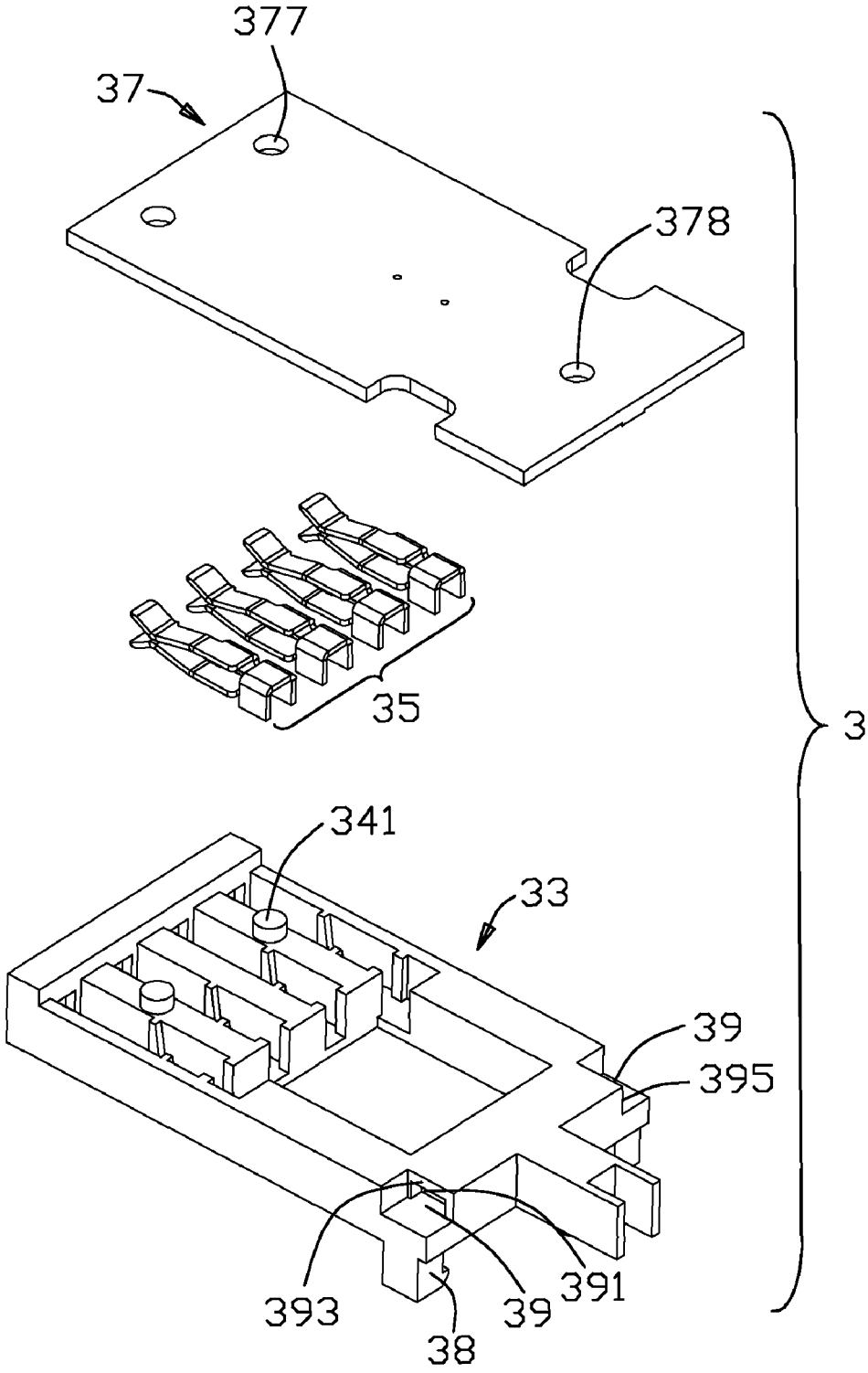
FIG. 7 is another exploded view of a contact module shown in FIG. 4 from an alternative direction.
Figure 8:
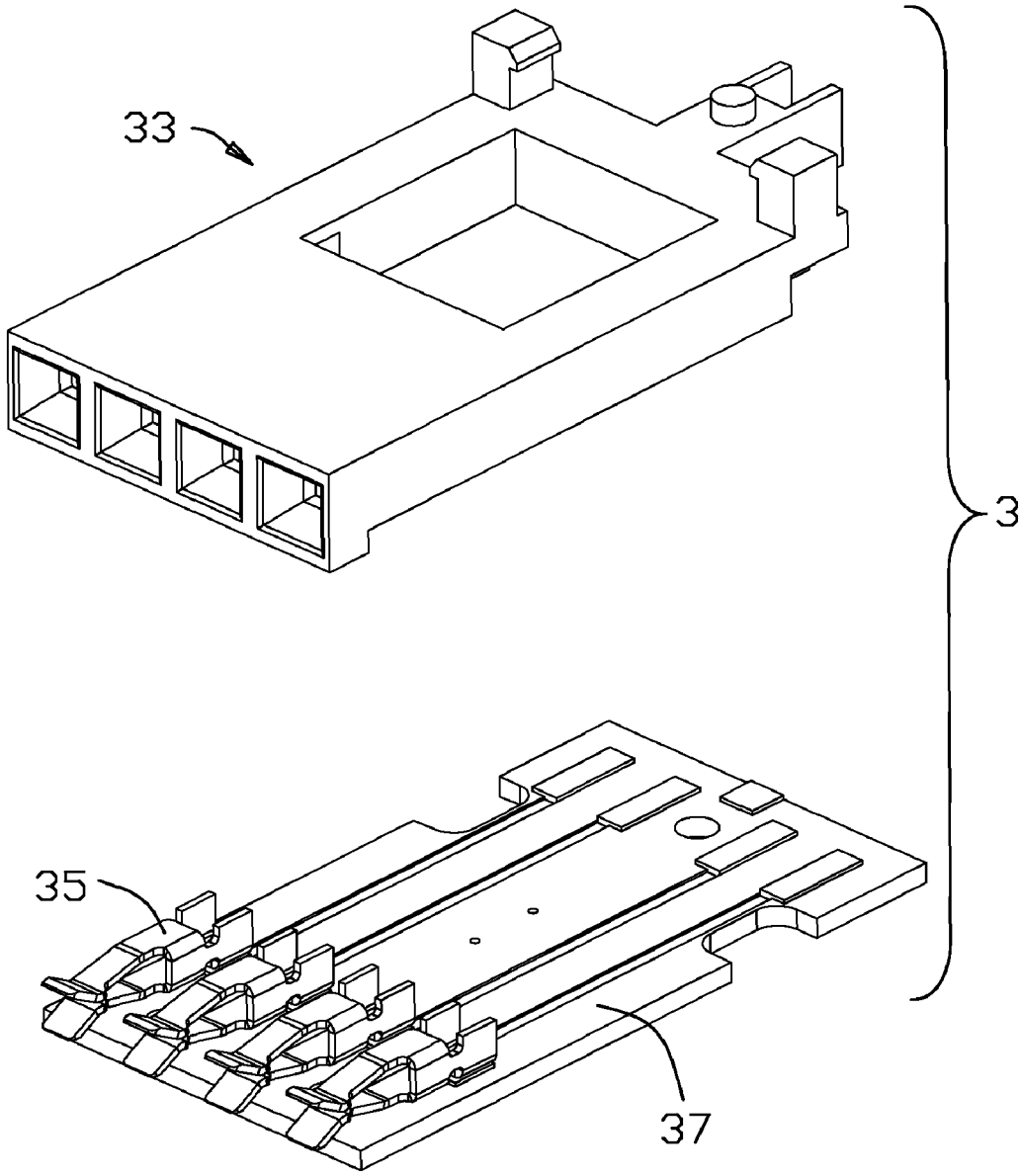
FIG. 8 is an exploded view of a contact module shown in FIG. 4 except that the contacts are soldered onto the printed circuit board.
Figure 9:
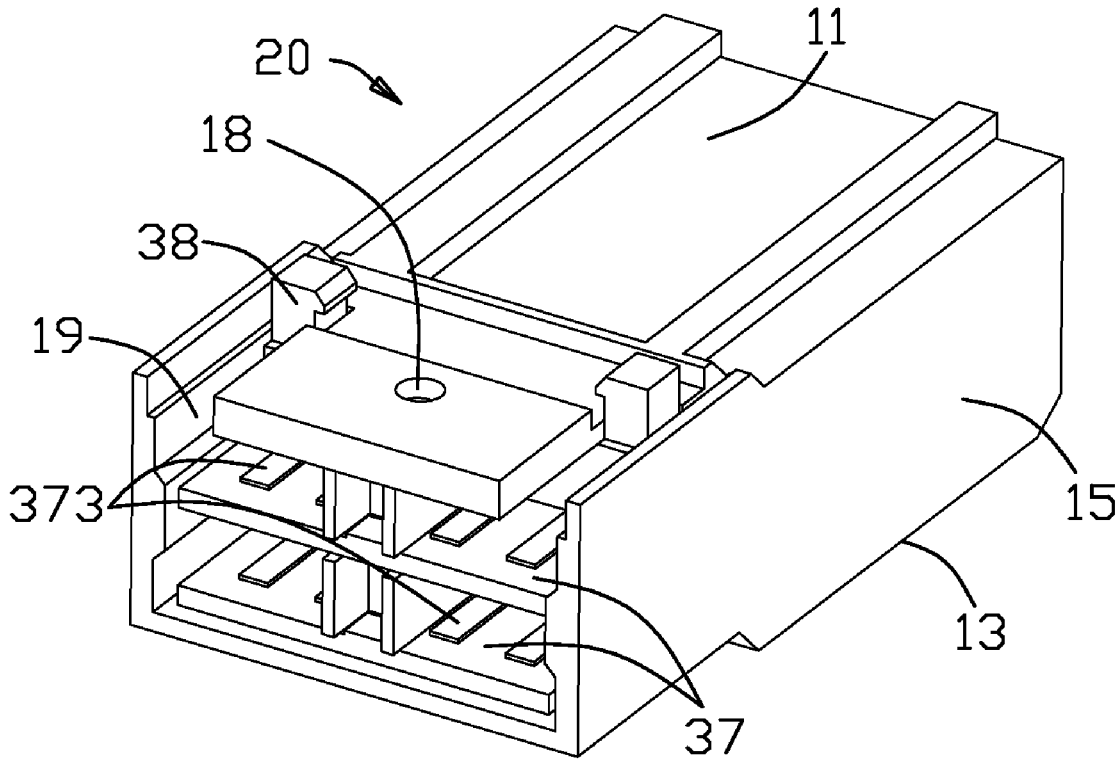
FIG. 9 is a perspective view of a connector body shown in FIG. 3.

The printed circuit board 37 defines three holes, a pair of holes 377 at a front portion and a hole 378 at a rear portion (referring to FIGS. 6-8). The housing 33 forms a post 388 and the cover 1 defines a hole 18 aligned with the hole 378 of the printed circuit board 37. The housing further forms a pair of posts 341 aligned to the pair of holes 377 of the printed circuit board 37. When the printed circuit board 37 is assembled onto insulating housing 33, the pair of the posts 341 of the insulating housing 33 mate into the pair of the holes 377 of the printed circuit board 37 and form the first or the second contact modules 3, 4. When the first and the second contact modules 3, 4 are stacked together, the post 388 of the insulating housing 33 of the second module 4 mates into the hole 378 of the printed circuit board 37 of the first module 3. When the stacked first and second contact modules 3, 4 are inserted into the insulating cover 1, the post 388 of the first contact module 3 mates into the hole 18 of the insulating cover 1.

The insulating cover 1 comprises a bottom wall 13, a top wall 11 and two side walls 15 connecting opposite ends of said top and bottom walls 11, 13 to define a cavity 17 therebetween. The top wall 11 defines a pair of slot 19 frontwardly extending from a rear end of the top wall 11. The bumps 38 of the first contact module 3 extend from the housing 33 and are slidable in the slots 19 when the first and the second contact module 3, 4 are inserted forwardly into said cavity 17. The top plate 95 of the top cover 91 defines a pair of apertures 951 receiving the bumps 38 of the first contact module 3 thereby fixing the connector body 20 to the cover means 9.

The disclosure is illustrative only, changes may be made in detail, especially in matter of shape, size, and arrangement of parts within the principles of the invention.

What is claimed is:

1. A cable end connector assembly comprising:

a cable comprising a plurality of conductors, a shield and a jacket, said cable having an end exposing said plurality of conductors and said shield; and a connector comprising a connector body for mating with a complementary mating connector, a cover means designed for electrical communication and securing said connector body, and connecting means fixed to the cover means;

wherein said connecting means comprises an outer ferrule having a first part crimped onto said jacket thereby fastening said connecting means to said cable and a second part crimped onto said shield for electrical communication, and an inner ferrule fastened substantially under said shield to said outer ferrule in the area of the second part for making an axial locking between said outer ferrule and said inner ferrule;

wherein the inner ferrule further comprises a plurality of resilient tab flexibly abutting said cover means thereby making electrical connection to said cover means.

2. A cable end connector assembly as claimed in claim 1, wherein a gap is defined between the inner ferrule and the cover means, said resilient tab extending slantwise towards the cover means therein.

3. A cable end connector assembly as claimed in claim 2, wherein the inner ferrule further forms a bump mating into a concavity defined in the cover means and thereby fixing said connecting means to said cover means.

4. A cable end connector assembly as claimed in claim 3, wherein the cover means comprises a bottom cover having a top surface and defining a half cavity in the top surface, and a top cover having a bottom surface facing the top surface of the bottom cover and defining another half cavity in the bottom surface, the bottom cover and the top cover cooperating to combine the two half cavities into a whole cavity receiving the connecting means.

5. A cable end connector assembly as claimed in claim 4, wherein the top cover further forms a top plate and the bottom cover forms a bottom plate, said connector body sandwiched between the top plate and the bottom plate.

6. A cable end connector assembly as claimed in claim 1, wherein said connector body comprises a first contact module and an insulating cover insulating said first contact module from said cover means, said first contact module comprising a plurality of conductive contacts respectively electrically connected to corresponding conductors of the cable, said first contact module forming a bump mating with the cover means thereby fixing said connector body to said cover means.

7. A cable end connector assembly as claimed in claim 6, wherein said first contact module further comprises a housing receiving said plurality of conductive contacts, said insulating cover defining a cavity to encase said first contact module, a slot extending from a rear end of the insulating cover, said bump of the first contact module extending from the housing and being slidable in the slot when the first contact module is inserted forwardly into said cavity.

8. A cable end connector assembly as claimed in claim 6, wherein the insulating cover comprises a bottom wall, a top wall and two side walls connecting opposite ends of said top and bottom walls to define a cavity therebetween, the top wall defining two slots beside said two side walls, said first contact module forming another bump mating with the cover means, said two bumps being slidable in corresponding slots when the first contact module is inserted into the cavity of the insulating cover.

9. A cable end connector assembly as claimed in claim 8, wherein said connector body further comprises a second contact module stacked with said first contact module, each of the two contact module defining a first and an opposite second surfaces, said two bumps disposed on the first surface and each bump having a latch and two concavities defined in the second surface, and wherein the two bumps of the second contact module respectively received in the two concavities and said latches mate with the first contact module.

10. A cable end connector assembly as claimed in claim 8, wherein said connector body further comprises a second contact module stacked with said first contact module, said first and second contact modules having a same configuration.

11. A cable end connector assembly as claimed in claim 6, wherein the cover means comprises a bottom cover having a top surface and defining a half cavity in the top surface, and a top cover having a bottom surface facing the top surface of the bottom cover and defining another half cavity in the bottom surface, the bottom cover and the top cover cooperating such that said two half cavity are combined to a cavity receiving the connecting means.

12. A cable end connector assembly as claimed in claim 1, wherein said connector body comprises a first contact module, a second contact module stacked with said first contact module and an insulating cover insulating said first and second contact modules from said cover means, each of the first and the second contact modules comprising a plurality of conductive contacts respectively electrically connected to corresponding conductors of the cable, said first contact module defining a pair of concavities, said second contact module forming a pair of bumps mating into said concavities of the first contact module and fixing the two contact module together.

13. A cable end connector assembly as claimed in claim 12, wherein said first contact module defines a first side surface in one of the concavities, a groove in said first side surface, a second side surface in the other concavity opposite to said first side surface, and a groove in said second side surface, each of said bumps of the second contact module forming a latch snapped into respective grooves of the first contact module thereby fixing the two contact modules together.

14. A cable end connector assembly as claimed in claim 13, wherein the first contact module has a pair of bumps extending through said insulating cover and mating with said cover means.

15. A cable end connector assembly as claimed in claim 14, wherein the first and the second contact module have a same configuration.

16. A cable end connector assembly as claimed in claim 15, wherein each of the first and the second contact modules further comprises a printed circuit board forming a plurality of first conductive pads connected to said contacts, a plurality of second conductive pads electrically connected between said first conductive pads and said plurality of conductors of the cable.

17. A cable end connector assembly as claimed in claim 16, wherein each of said first and second contact modules includes an insulative housing receiving the corresponding contacts which are assembled into the housing via an opening in one of the housings along a direction perpendicular to a mating direction of said contacts, and wherein the printed circuit board is assembled to the housing in said direction and covers said opening so that the printed circuit board defines at least one through hole receiving at least one post unitarily extending from said face of the housing.

18. A cable end connector assembly as claimed 17, wherein the printed circuit board of the first contact module is sandwiched between the housing of the first contact module and the housing of the second contact module.

19. A cable end connector assembly as claimed in claim 18, wherein the printed circuit board of the first contact module defines a pair of notches on two sides to receive the corresponding bumps of the second contact module.

* * * * *